US006231143B1

(12) United States Patent
Stijns

(10) Patent No.: US 6,231,143 B1
(45) Date of Patent: May 15, 2001

(54) OVER-EXTENDIBLE DIFFERENTIAL DRAWER GUIDE

(75) Inventor: Andreas Petronella Maria Stijns, Bunde (NL)

(73) Assignee: Thomas Regout B.V., Maastricht (NL)

( * ) Notice: Subject to any disclaimer, the term of this patent is extended or adjusted under 35 U.S.C. 154(b) by 0 days.

(21) Appl. No.: 09/230,292

(22) PCT Filed: Jul. 18, 1997

(86) PCT No.: PCT/NL97/00427

§ 371 Date: Mar. 2, 1999

§ 102(e) Date: Mar. 2, 1999

(87) PCT Pub. No.: WO98/03099

PCT Pub. Date: Jan. 29, 1998

(30) Foreign Application Priority Data

Jul. 23, 1996 (NL) ..... 1003665

(51) Int. Cl.[7] ..... A47B 88/08
(52) U.S. Cl. ..... 312/331; 312/334.8
(58) Field of Search ..... 312/331, 334.6, 312/334.12, 334.8, 334.13, 334.32, 334.9, 334.11, 334.15, 334.33, 334.1; 384/18, 19, 22, 17

(56) References Cited

U.S. PATENT DOCUMENTS

| | | | | |
|---|---|---|---|---|
| 2,267,043 | * | 12/1941 | Premo | 312/331 X |
| 3,124,401 | * | 3/1964 | McClellan | 312/334.13 |
| 3,385,639 | * | 5/1968 | Aiken, Sr. | 384/17 |
| 3,687,505 | | 8/1972 | Fall . | |
| 3,912,341 | | 10/1975 | Stein . | |
| 4,324,439 | * | 4/1982 | Hagen et al. | 312/331 X |
| 5,492,400 | * | 2/1996 | Rock | 312/331 |

FOREIGN PATENT DOCUMENTS

| | | | | |
|---|---|---|---|---|
| 27166 | * | 1/1991 | (CH) | 312/334.12 |
| 2 307 041 | | 2/1972 | (DE) . | |
| 0 664 984 | | 8/1995 | (EP) . | |
| 2 217 918 | | 9/1974 | (FR) . | |
| 8 304 456 | | 7/1985 | (NL) . | |

* cited by examiner

*Primary Examiner*—Janet M. Wilkens
(74) *Attorney, Agent, or Firm*—Weingarten, Schurgin, Gagnebin & Hayes LLP

(57) ABSTRACT

A drawer guide of the over-extendible type, including a movement-control element or elements for controlling the movements of the sections of the drawer guide relative to one another. During operation, the movement-control element or elements remain in connection with multiple sections of the drawer guide. Movements of the control element or elements are dynamically coupled, in such a manner that control is maintained during the complete path of movement of the sections of the drawer guide.

8 Claims, 6 Drawing Sheets

OVER-EXTENDIBLE DIFFERENTIAL DRAWER GUIDE

BACKGROUND OF THE INVENTION

The invention relates to a drawer guide of the over-extendible type, comprising movement-control means for controlling the movements of the sections of the drawer guide relative to one another in at least the non-over-extended portion of the path of movement of the sections. Such drawer guide is known from U.S. Pat. No. 3,912,341.

The known drawer guide comprises a drawer section, an intermediate section and a case section. The case section has a substantially U-shaped crsoss-section, having a short first leg and a relatively long second leg, with which the case section cann be attached to a case wall. The intermediate section has a generally E-shaped cross-section and overlaps the first leg of the case section, a slide-bearing element being positioned there between. The drawer section has a substantially U-shaped cross-section overlapping the top side of the intermediate section. A wheel shaped bearing is positioned between the middle bar of the E-shaped intermediate section, the axis of rotation of the wheel being attached to the case section. Thus the intermediate section is positioned substantially above the case section, the drawer section being positioned substantially above the intermediate section, partly enclosed between the case section and the intermediate section. This known drawer guide is thus relatively bulky.

On the wall of the intermediate section, extending vertically, a first and second guide wheel are provided, one near each end of said section, having an axis of rotation extending horizontally, perpendicular to said wall. A wire shaped connecting element is guided around said wheels. A first coupling is connected to the wire and the case section in a first position, a second coupling to the wire and the drawer section in a second position, the first and second positions being apart over half the length of the wire. Thus, when the drawer section is moved relative to the intermediate section, the case section is moved over the same distance and in opposite direction relative to the intermediate section. The drawer guide is of the over extendible type.

This known drawer guide has the disadvantage that the connecting element extends in a vertical plane, parallel to the wall of the intermediate section. This means that a relatively large space has to be available between the intermediate section and the drawer section to provide for the wheels, the wire shaped element and the couplings. Furthermore, the wire shaped element can run on the wheels, impairing a proper functioning of the drawer guide.

U.S. Pat. No. 3,912,341 discloses a drawer guide comprises a case section and a drawer section disposed parallel thereto, while between the case section and the drawer section, an intermediate section is included. The drawer section and the case section are bearing-mounted so as to be movable relative to the intermediate section. The sections are constructed so that the sections are movable into an end position wherein the drawer section and the case section no longer overlap, the so-called over-extended end position. In the intermediate section, a window is provided accommodating a roller manufactured from resilient material. As long as the case section and the drawer section both overlap the window, the roller abuts on one side of the window against the inside of the case section and on the opposite side against the inside of the drawer section. This involves the roller being slightly compressed so that there is a firm frictional contact. The roller acts as movement-control means for the sections, so long as the case section and the drawer section both overlap the window. This can be understood as follows.

During use, the roller can only rotate within the window about an axis in the plane of the window, at right angles to the direction of movement of the sections. When the intermediate section moves relative to the case section in a first direction, the roller is rotated as a result of the friction, while pushing away the drawer section and vice versa. The distance travelled by the drawer section relative to the intermediate section is equal to the movement of the intermediate section relative to the case section. This has as a result that during the part of the path of movement in which the roller contacts both the drawer section and the case section, the movement of such a guide and, accordingly, for instance a drawer suspended therefrom, is even, quiet and accurately controlled.

However, the known drawer guide has the drawback that in the portion of the path of movement where the case section and the drawer section no longer both overlap the window, the movements of the drawer section relative to the case section are no longer controlled, while, moreover, at least either the case section or the drawer section can move freely relative to the intermediate section. This creates a relatively abrupt transition in the path of movement and in the movement pattern of the drawer guide when one of the sections loses contact with the roller, or, by contrast, enters into contact therewith, the more so because this involves the roller suddenly springing outward or having to be slightly compressed. This relatively abrupt transition has as a consequence that the movement pattern of a drawer suspended by such drawer guides is uneven and hence unpleasant, while, moreover, the contents of such drawer may easily start to move through the drawer due to an occurring impact. Further, because of this transition, an irksome noise is created. A further drawback is that due to the roller continuously entering into and losing contact with at least one of the sections, the roller will be subject to wear, while, moreover, this wear could be irregular because the position of the roller at the moment of entering into contact will always be substantially the same. As a consequence, the roller will in the end become asymmetrical and hence produce a jerky movement pattern.

A further major drawback of this known drawer guide is that the roller is subject to wear, because through a portion of the path of movement it slides over one of the sections rather than rolling therealong. This causes a flattening of at least a part of the tread of the roller, which adversely affects the rolling properties thereof. This can be understood as follows. When the guide is being slid in, the first section will already reach the end position relative to the intermediate section, while this does not yet apply to the third section. Hence, in the final part of the sliding-in path of the third section, rotation of the roller is prevented by the first section, and therefore, the roller starts to slide over the first section and wear occurs.

German Offenlegungsschrift 2 307 041 discloses a comparable drawer guide, with the case section extending along the bottom side of the intermediate section and the drawer section extending along the top side thereof. Between the top side of the case section and the bottom side of the drawer section, a runner is included as control means. This known drawer guide has drawbacks comparable with the drawbacks of the above-described drawer guide.

Dutch Patent Application NL-A-8304456 discloses a drawer guide of the overextendible type, in which the ball cages between first and second and second and third section respectfully are interconnected by two cables, such that upon movement of one of the ball cages the second ball cage moves over the same distance in opposite direction. The outer sections then move in opposite directions relative to the intermediate section due to friction of the ball cages to the respective sections. This drawer guide has the disadvantage that these sections can move relative to the respective ball cages independently from the other sections, by sliding over the ball cages, overcoming said friction.

BRIEF SUMMARY OF THE INVENTION

The object of the invention is to provide a drawer guide of the type described, wherein the drawbacks mentioned are avoided and the advantages thereof are retained. To that end, a drawer guide according to the invention is described herein.

The first and second control means have the advantage that in each case, each of the control means can be and remain in contact with at least one of the sections that move relative to the other sections. The coupling means provide that a movement of the first control means results in a comparable movement of the second control means, in such a manner that, during use, a movement of one section connected to a control means causes, via the relevant control means, the coupling means and the other control means, a section connected thereto to move in a controlled manner in opposite direction and vice versa, during the complete path of movement of the sections relative to each other. Precisely through the provision of control of the movements along the complete path of movement, i.e. as far as the over-extended position, the drawbacks of the known drawer guides are prevented. This prevents, in an inventive manner, impacts and the like in the movement pattern of the drawer guide and, accordingly, also in the movement patterns of a drawer or the like suspended thereby. The movements of the sections of these guides are accurately controlled, so that movements of the different sections take place simultaneously and in a comparable manner. Undesired wear and noises are thereby readily prevented, so that a drawer guide according to the invention is more agreeable in use and moreover more durable than comparable drawer guides of the known type.

Since in a drawer guide according to the present invention the loop shaped connecting element extends around the second section, the second section can easily be enclosed between the first and third section, providing for a compact drawer guide, whereas the connecting element can not come apart from the second section, thus ensuring proper functioning of the drawer guide.

The fixed connection of the control means to the relevant drawer sections provides a positionally fixed connection, while the connecting element effects in a simple manner the intercoupling of the control means. Moreover, this prevents the control of the movements of the sections from depending on frictional forces as in the case of the roller of the known drawer guide. Such frictional forces will inevitably cause wear, while in the known drawer guide, slip may moreover occur, whereby the sections no longer enter into the final positions simultaneously, as a consequence of which for instance the drawer guide can no longer be slid in and/or out completely, more wear occurs and additional operating forces are required. In a drawer guide as described herein, no slip can occur. Moreover, no control means or other means whatsoever need to be compressed during movement of the sections, which renders these movements even smoother. The angle of about 180° or at least an angle possibly composed therefor in the or each connecting element offers the advantage that the movements of the control means will have the same distances but opposite directions, with the connecting element providing that this will be the case at all times. Thus, the opposite direction of movement of the first and third sections is readily obtained.

In an alternative embodiment, the controlled movements of the sections relative to each other are obtained by the rollers included, preferably slightly compressed, between the sections. As the rollers are dynamically intercoupled in such a manner that through movement of one of the roll-shaped elements, an identical movement is generated at the or each other roll-shaped element, the movements of the sections correspond or are at least directly related to each other. The intermediate distance between the roll-shaped elements provides the possibility that also in the over-extended part of the path of movement, the sections remain in contact with always at least one of the roll-shaped elements and are hence moved in a controlled manner. In this connection, through a choice of the cross section of the roll-shaped elements, the measure of movement of the sections can be determined. In this respect, 'roll-shaped element' should be understood to mean a roll or sphere or like object.

In a first advantageous further embodiment, in a drawer guide according to the invention the coupling means for instance as rod-shaped body, coupled to each roll-shaped element spaced from the axis of rotation thereof, the treads of the roll-shaped elements are kept clear for abutment against the sections and angular rotation of the roll-shaped elements relative to each other is prevented. Such coupling is simple, direct and effective.

In a further alternative embodiment, a drawer section according to the invention is characterized by the following features:

The cable-shaped elements can be fixedly connected to the ends of the sections in a simple manner, so that during movements of the sections, slip is readily prevented. Moreover, in such an embodiment, the sections can in a particularly simple manner be arranged so as to be relatively far apart, above as well as next to each other, while the sections are movable to both sides in the same manner. In each case, one of the cable-shaped elements will be subjected to a tensile load. In this embodiment, a drawer guide is easy to assemble, maintain and repair, and it moreover requires no closed loops or the like as coupling means.

In a particularly advantageous embodiment, a drawer guide according to the invention is further characterized by the following features:

A two-sidedly extendible drawer guide offers the advantage that a drawer or supporting window suspended thereby can be pulled out of a case from two opposite sides and is hence better accessible. Moreover, the same section can be used to the left as well as to the right in a case, for the same drawer, which may offer advantages in terms of economy and production. After all, it is thus provided that only one type of drawer guide needs to be stocked.

The invention further relates to a case element comprising a number of drawer guides according to the invention.

Further advantageous embodiments are described below.

BRIEF DESCRIPTION OF THE DRAWINGS

To explain the invention, exemplary embodiments of a drawer guide will hereinafter be described with reference to the accompanying drawings. In these drawings.

DETAILED DESCRIPTION OF THE PREFERRED EMBODIMENTS

Figure 1:
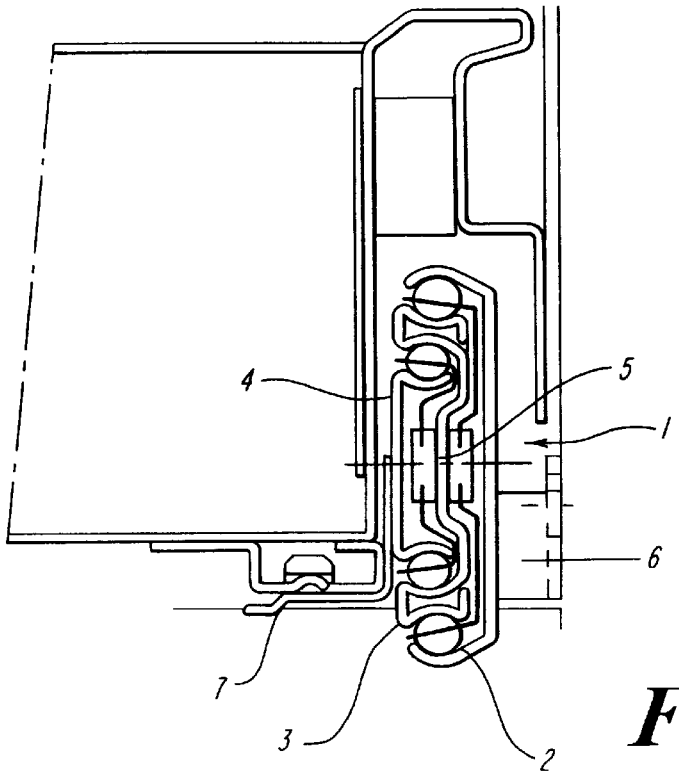
FIG. 1 is a front view of an assembled drawer guide in a first embodiment.

FIG. 1 is a front view of a drawer guide 1 according to the invention, comprising a first section 2 termed case section, a second section 3 termed intermediate section, and a third section 4 termed drawer section. Included between the case section 2 and the intermediate section 3 and between the intermediate section 3 and the drawer section 4 are bearing cages 5, in a manner known per se. As a result, the three sections 2, 3, 4 are slidable relative to each other in the longitudinal direction of the drawer guide. The case section 2 is provided with two dents 6 whereby it can be attained to for instance a case wall. The drawer section 4 comprises two brackets 7 whereby a drawer or the like can be attached to the drawer section 4, as shown in interrupted lines in FIG. 1. The construction for such drawer section 1 is known per se.

Figure 2:
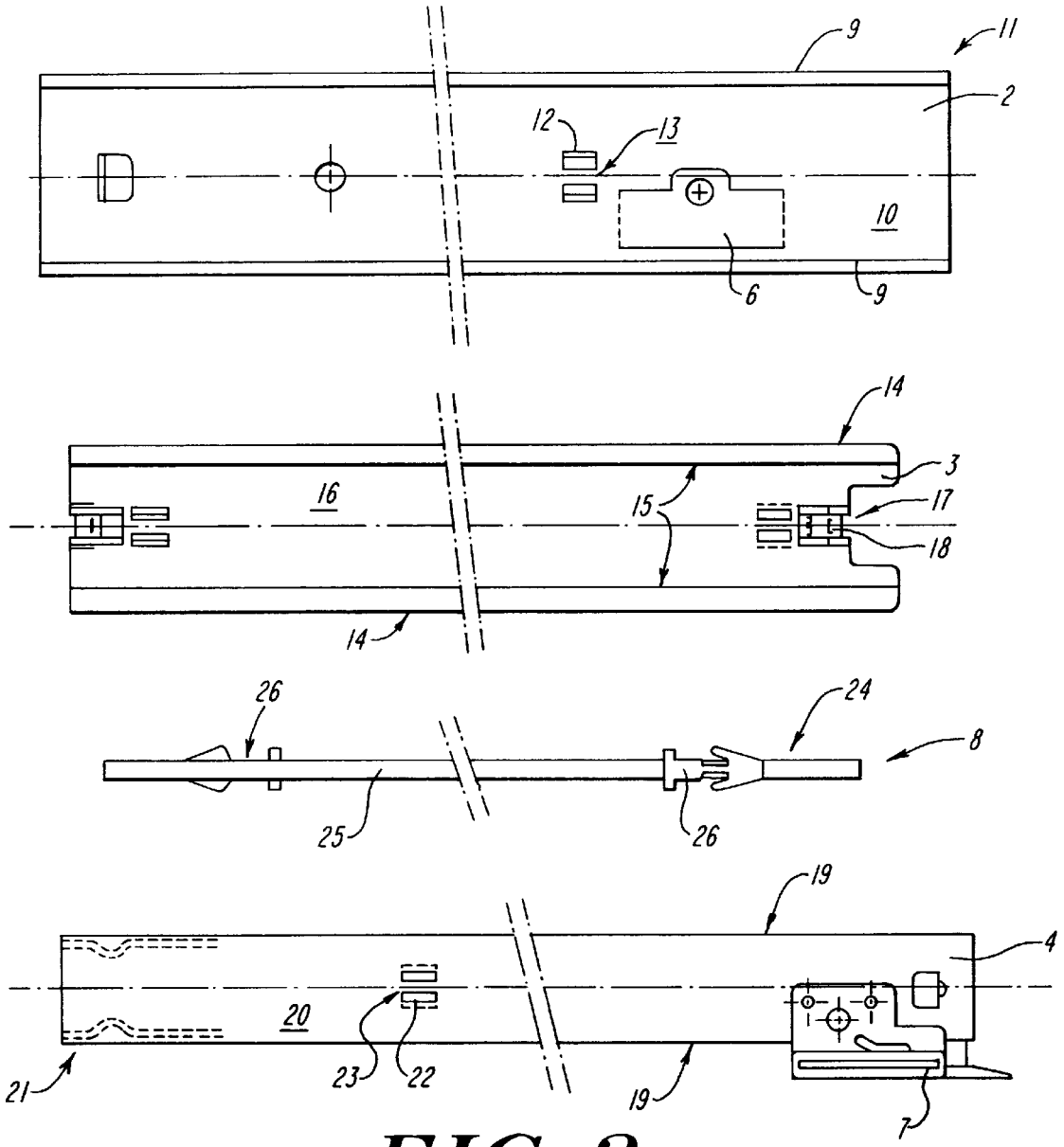
FIG. 2 is a side elevational view of a disassembled drawer guide according to FIG. 1, with bearings left out.

FIG. 2 shows the three sections one above the other, together with the control and coupling means 8 according to the invention. These parts will only be discussed in detail in so far as it is necessary for a proper understanding of the invention.

The case section 2 is manufactured from for instance strip steel and comprises a top and a bottom ball track 9, between which the relevant bearing cage 5 is movably receivable, and an intermediate sectional face 10. Adjacent a first end 11, this case section 2 comprises two lips 12 extending parallel to each other and at right angles to the direction of movement of the sections in the direction of the intermediate section 3, which lips 12 are spaced some distance apart and thus enclose a first interspace 13. The purpose thereof will be further explained hereinbelow.

The intermediate section 3, manufactured in a manner comparable with that of the case section 2, is provided with a top and a bottom outer ball track 14, a top and a bottom inner ball track 15, and an intermediate sectional face 16. The outer ball tracks 14 can cooperate with the outer bearing cage 5 capable of cooperating with the case section 2, the inner ball tracks 15 can cooperate with the inner bearing cage 5 capable of cooperating with the drawer section 4. The sectional face 16 is at least near the center thereof slightly shorter than the ball tracks 14, 15, and is at both ends provided with a recess 17. In this recess 17, a guide wheel 18 is in each case accommodated, which will be further described hereinbelow, together with the purpose thereof.

The drawer section 4, manufactured in a manner comparable with that of the case section 2, is provided with a top and a bottom outer ball track 19 capable of cooperating with the above-mentioned inner bearing cage 5, and a sectional face 20. Adjacent a second end 21, which in an assembled drawer guide 1 is located on the side remote from the first end 11 of the case section 2, the sectional face 20 comprises two lips 22, comparable with the lips 12 on the case section. These lips 22 include a second interspace 23, the purpose of which will be explained in more detail hereinbelow.

Figure 4:
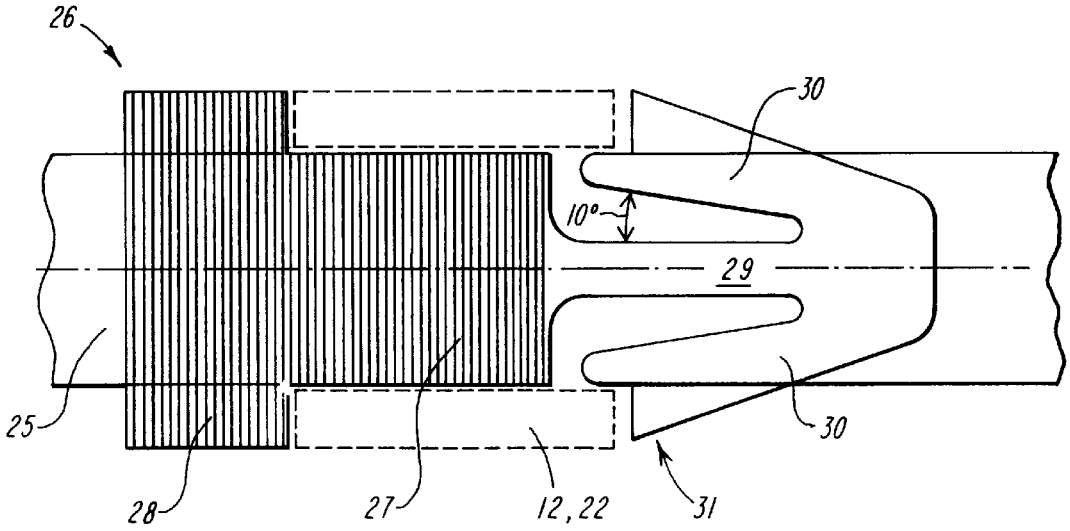
FIG. 4 is a side elevational view of a control means for a drawer guide according to FIG. 1.

The movement-control means 23 comprise a band-shaped element 25, closed in itself, that can be fittingly provided over the guide wheels 18 and the sectional face 16 enclosed therebetween. Hence, the band-shaped element 25 can be guided over the guide wheels around the sectional face 26. At opposite positions, the band-shaped element 25 comprises a securing element 26, located on the outside and designed as a somewhat arrow-shaped securing element, as shown in an enlarged view in FIG. 4. Each securing element 26 comprises a body part 27 having a relatively wide foot 28 and, on the opposite side, a narrow neck part 29. Extending on either side from the free end of the neck part 29 are two resilient lips 30, inclined relative to the longitudinal direction of the neck part 29 in the direction of the body part 27. The taking up stress changes. In this connection, the band-shaped element 25 can be composed of two parts intercoupled by or at least at the location of the coupling elements, or can be loop-shaped by itself.

A drawer guide 1 according to FIGS. 1–3 can be used as follows.

At opposite positions, two drawer guides 1 are connected via the case sections 2 to a case element, after which, for instance, a drawer element is hung thereinbetween on the drawer sections 4. When the drawer element is pulled out from a completely slid-in position, the drawer section 4 moves relative to the intermediate section 3. This involves the securing element 26 connected to the drawer section being moved along forwards, which means that the band-shaped element 25 is pulled around the intermediate section 3. Because the case section 2 is positionally fixed relative to the case element and, accordingly, the band shaped element 25 connected thereto cannot move, the intermediate section 3 will, during the movement of the drawer section 4, be moved forwards, i.e. in the same direction as the drawer element, through a distance equal to half the distance through which the drawer section 4 is moved relative to the case section 2. This effect occurs throughout the path of movement of the sections. In other words, the movement of the sections and, accordingly, of the drawer element are continuously controlled, also when the drawer element is moved into the slid-in position again.

Figure 3:
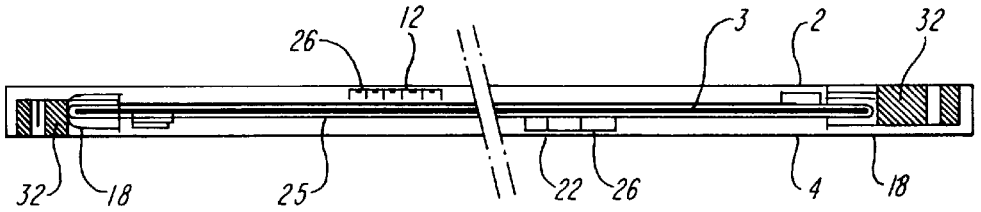
FIG. 3 is a sectional top plan view of a drawer guide according to FIGS. 1 and 2, in assembled form and with removed central portion and bearings.

In the drawer guide 1 shown in FIGS. 1–3, the drawer section 4 can be moved forwards so far that when it is in the completely extended position, it projects completely from the case section 2, viewed in side elevation. This means that the drawer guide is over-extendible. Owing to the band shaped element 25, the control of the movements of the sections relative to each other is also fully maintained in the over-extended part of the path of movement. This prevents the occurrence of impacts and, consequently, shifting of the contents of the drawer element during the movements of the drawer element. Irksome noises, as occur with the known drawer guides due to engagement and disengagement of the control means, are avoided and, when the drawer element is equally loaded, the load on the drawer guide 1 is equal at each movement of the drawer element, because the position of the sections relative to each other will be equal at any slide-in and slide-out movement. Moreover, the operation of the movement-control means is maintained during the entire lifetime of the drawer guides.

Figure 5:
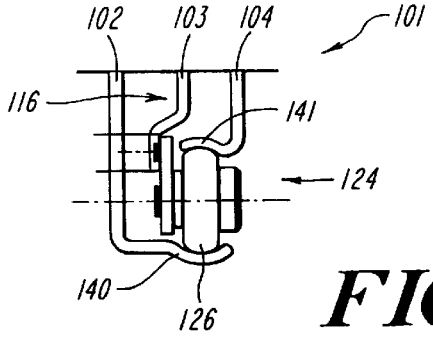
FIG. 5 is a front view of a first alternative embodiment of a drawer guide according to the invention.
Figure 6:
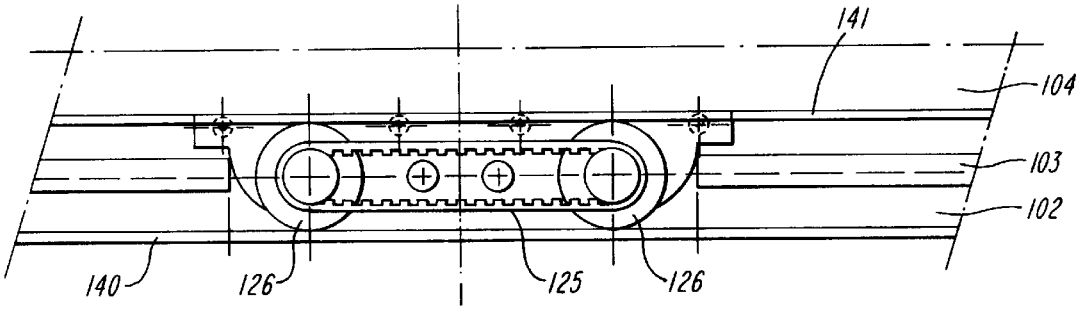
FIG. 6 is a side elevational view of a first embodiment of the control and coupling means of a drawer guide according to FIG. 5.
Figure 7:
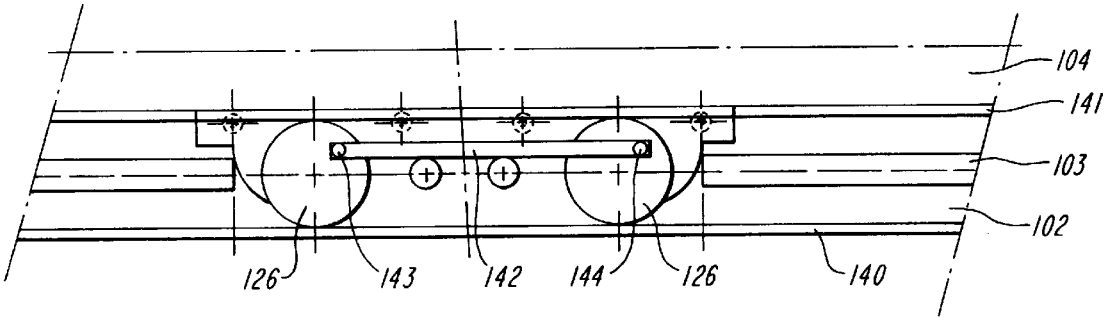
FIG. 7 is a side elevational view of a second embodiment of the control and coupling means of a drawer guide according to FIG. 5.

FIG. 5 schematically shows, in side elevation, an alternative embodiment of a drawer guide 101 according to the invention. In this Figure, identical parts have identical reference numerals, increased by one hundred. In FIG. 5, only the relevant parts of the drawer guide, in particular the sections, are shown. FIGS. 6 and 7 show two alternative embodiments of the movement-control means 124.

The drawer guide 101 comprises a case section 102, an intermediate section 103 and a drawer section 104, again bearing-mounted for sliding relative to each other with the interposition of conventional bearing cages, not shown. Incorporated into the central area of the intermediate section 103, viewed in longitudinal direction, are two wheels 126 acting as control means. In the embodiment shown, the axes of rotation of the wheels 126 are at right angles to the direction of movement of the sections and at right angles to the sectional face 116 of the intermediate section 103. In a first path of movement, with the case section 102 and the drawer section 104 still partly overlapping, the two wheels 126 abut against a track 140 of the case section 102 as well as a track 141 of the drawer section 104. Hence, rotation of the wheels 126 results in that the case section 102 is moved in a first direction relative to the intermediate section 103, while at the same time the drawer section 104 is moved in opposite direction, as the tracks 140, 141 abut on opposite sides of the wheels 126. Because the wheels 126 are equal, the distance through which the sections are moved is equal.

In a second path of movement, the so-called over-extended path in which the case section 102 no longer overlaps the drawer section 104, only one wheel 126 is still in tough with the track 140 of the case section 102, while the other wheel 126 is only in touch with the track 141 of the drawer section 104.

In order to keep the movements of the two wheels 126 equal to each other also in this over-extended path, the wheels 126 are dynamically intercoupled by coupling means. Such drawer guide can be over-extendible one-sidedly or two-sidedly.

In the embodiment shown in FIG. 6, the coupling means comprise a toothed belt 125 extending around the axes of the wheels 126 and thereby couple the movements of one wheel 126 to the movements of the other wheel 126. As a result, a rotation of one wheel 126, occurring through movement of the drawer section 104 relative to the intermediate section 103, brings about an equal movement of the other wheel 126, which movement in turn brings about an equal movement of the intermediate section 103 relative to the case section 102 and vice versa. As a result, control of the movements of the sections is also provided in the over-extended part of the path of movement of the sections. The length of the over-extended part of the path of movement substantially corresponds to the distance between the axes of the wheels 126. In fact, the toothed belt can also be guided over the treads of the wheels in such a manner that the toothed belt acts as a traveling belt. Moreover, other types of band elements and the like may of course be used for intercoupling the wheels 126, the wheels may be identical to as well as different from each other and in each case, one or both wheels may each be in contact with only one of the outer sections, provided that this is not the same section for both wheels. This provides the possibility, through a suitable selection of wheels or supporting face for the bands having different diameters, or causing the movements of for instance the case section 102 relative to the intermediate section 103 to differ, at least in distance, from the movements of the drawer section 104 relative to the intermediate section 103. This may for instance be advantageous for a proper distribution of forces.

In the embodiment shown in FIG. 7, the coupling means are formed by a coupling rod 142. The first end 143 of the coupling rod is rotatably connected to the first wheel 126, at a distance from the axis of rotation, while the second end 144 of the coupling rod 142 is similarly connected to the second wheel 126. As a result, during rotation of the one wheel, the coupling rod 142 acts as drive rod for the other wheel and vice versa, so that the movements of the two wheels are exactly controlled relative to each other.

Of course, the movements of the wheels 126 can also be coupled by for instance gear transmissions or otherwise known transmission mechanisms. Moreover, the wheels can be arranged in a different manner, for instance horizontally between vertical sections of inclined between for instance a horizontal drawer section 104 and a vertical case section 102.

Figure 8:
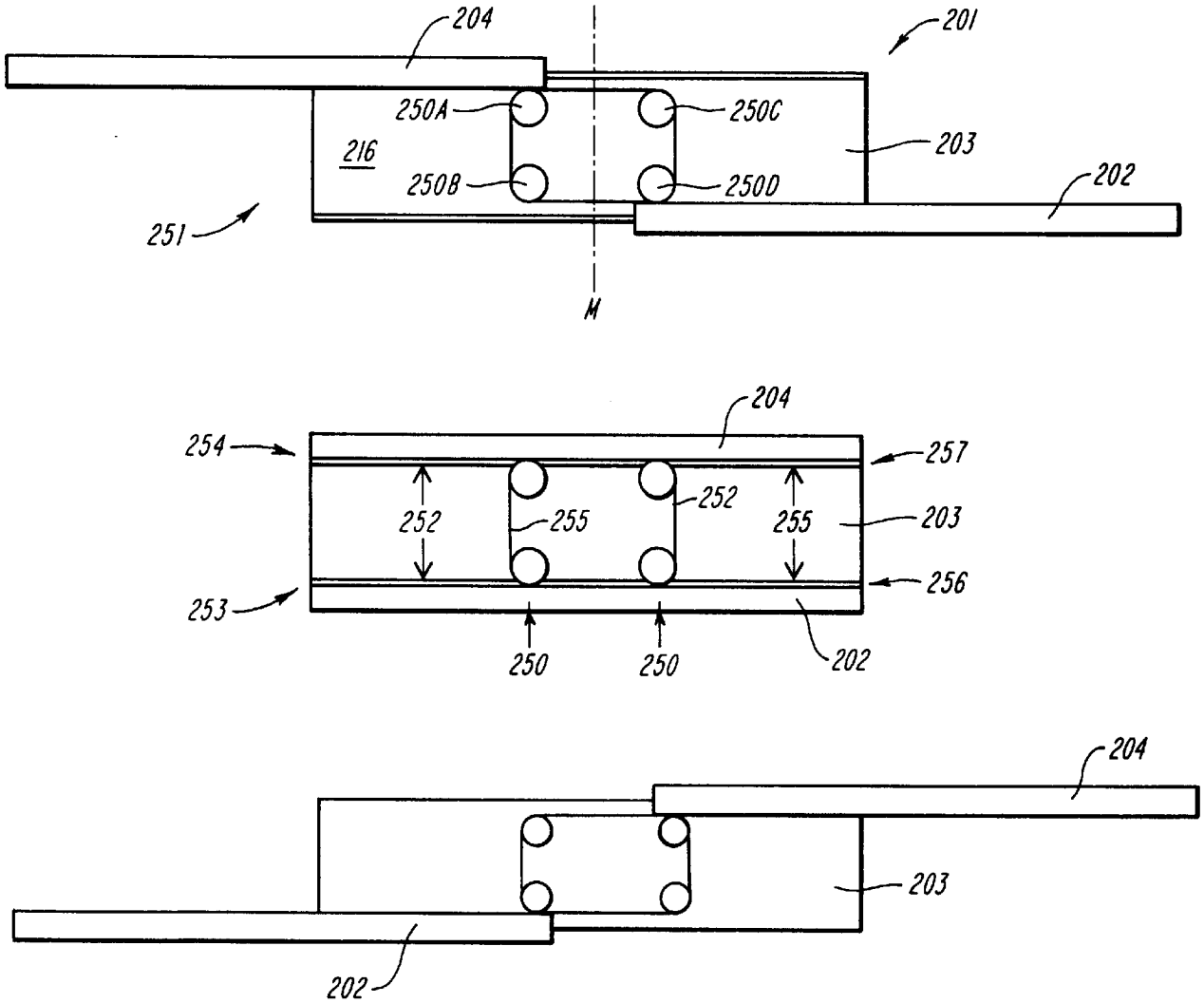
FIG. 8 is a side elevational view of a second alternative embodiment of a drawer guide according to the invention, in three positions.

FIG. 8 shows a further alternative embodiment of a drawer guide 201 according to the invention. Identical parts have identical reference numerals as in FIGS. 1–4, increased by 200.

A drawer guide according to FIG. 8 comprises an intermediate section 203 whose top and bottom sides are provided with tracks for a superjacent drawer section 204 and a subjacent case section 202 respectively. The drawer section 204 and the case section 202 can both move in two directions relative to the intermediate section 203, so that this drawer guide is extendible two-sidedly.

Arranged in the central area of the intermediate section 203 are two pairs of guide wheels 250, rotatable in a plane parallel to the sectional face 216 of the intermediate section 203. Of each pair of guide wheels 250, a first guide wheel 250A respectively 250C is arranged immediately below the bottom side of the drawer section 204 and the other guide wheel 250B respectively 250D is arranged therebelow, adjacent the top side of the case section 202. The first pair of guide wheels 250A, 250B is arranged on the side of the center M of the intermediate section 203 which side faces the first end 251 of the drawer guide, the other pair of guide wheels 250C, 250D is arranged on the other side thereof, equally spaced from the center M.

A first cable 252 is connected by a first end 253 to the first end of the case section 202 which end is located adjacent the first end of the drawer guide, and by the opposite second end 254 to the first end of the drawer section 204 which end is located adjacent the first end of the drawer guide. Between these ends 253, 254, the cable 252 is guided around the guide wheels 250C, 250D of the second pair of guide wheels 250. This involves the first cable 252 lying taut along the guide wheels 250 and along the intermediate section 203. Likewise, a second cable 255 is connected by a first end 256 adjacent the second end of the case section 202 and by a second end 257 adjacent the second end of the drawer section 204. The part of this second cable 255 lying between the two ends 256, 257 is fittingly guided along the guide wheels 250A, 250B of the first pair of guide wheels 250. When a drawer guide 201 is completely slid in, the first end 253 of the first cable 252 lies directly below the second end 254 thereof, the first end 256 of the second cable 256 lies directly below the second end 257 thereof (FIG. 8, central position).

If in a drawer guide 201 according to FIG. 8, from the midway position as shown in the middle drawing of FIG. 8, the drawer section 204 is moved leftwards, the intermediate section 203 is entrained through half the distance if the case section 202 is held stationary. By the first cable 252, a pull is transmitted from the drawer section to the case section during the complete path of movement of the sections, as a result of which the movements of the sections continue to take place in a controlled manner. This over-extended position is shown in the top drawing of FIG. 8. When the drawer section 202 is slid back, the second cable 255 exerts a pull from the drawer section 204 on the case section 202, so that sliding-in takes place in a controlled manner as well. The drawer guide 201 can be moved past the midway position (FIG. 8, middle drawing) into the opposite end position, as shown in the bottom drawing of FIG. 8. This movement, too, is completely controlled by the second cable 255, while the movement back into the above-mentioned midway position is again controlled by the first cable. The drawer guide is two-sidedly over-extendible through a distance corresponding to the distance between the two pairs of guide wheels 260. As a matter of fact, a drawer section 201 according to FIG. 8 can also be designed so as to be extendible one-sidedly.

In particular, a drawer guide according to FIG. 8 has moreover the advantage that the same drawer guide can be used on either side of a drawer element, so that only one type of drawer guide is required for hanging a drawer element, which has important advantages in terms of economy and production.

Figure 9:
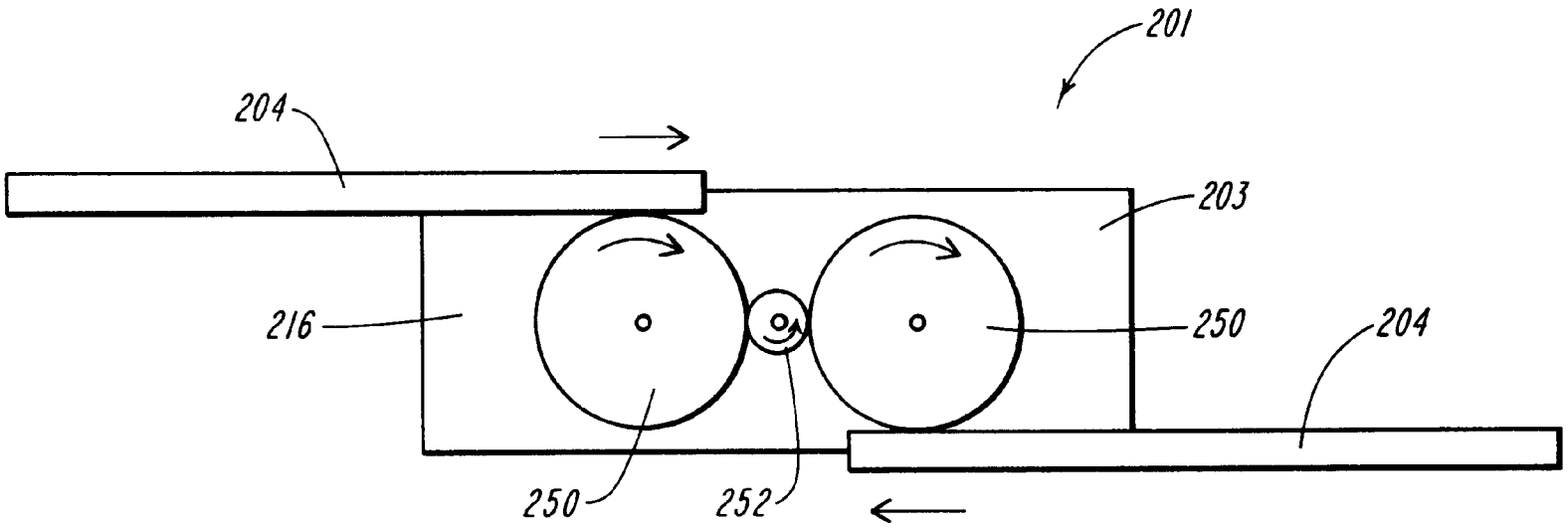
FIG. 9 is a side elevational view of a third alternative embodiment of a drawer guide according to the invention.

FIG. 9 shows a further alternative embodiment of a drawer guide according to the invention. Identical parts have identical reference numerals as in FIG. 8. In this embodiment, the drawer guide 201 again comprises an intermediate section 203, a case section 202 and a superjacent drawer section 202. Provided on the intermediate section 203 are two relatively large runners 250 whose axes of rotation extend as normal lines to the sectional face 216. Between the two wheels 250, a small runner 252 is included, as coupling means. The small runner 252 abuts against the treads of the two wheels 250, so that rotation of one of the wheels always results in a rotation of the other wheel. Further, each of the wheels 250 in each case abuts by its tread against at least the case section or the drawer section, at least one wheel against at least one section. In this manner, a drawer guide that can be designed so as to be one-sidedly or two-sidedly over-extendible is readily obtained. The arrows drawn in FIG. 9 show the coupled movements of the wheels 250 and the sections 202, 203 and 204 in the slide-in direction. In fact, the small runner 252 can also be replaced by a band element, for instance such as shown in FIG. 6 and/or such band element can be arranged around two pairs of wheels 250 as shown in FIG. 8, as long as the treads of at least two wheels 250 abut against the sections 202 and 204 on opposite sides, and/or the band element trained around the wheels.

Figure 10:
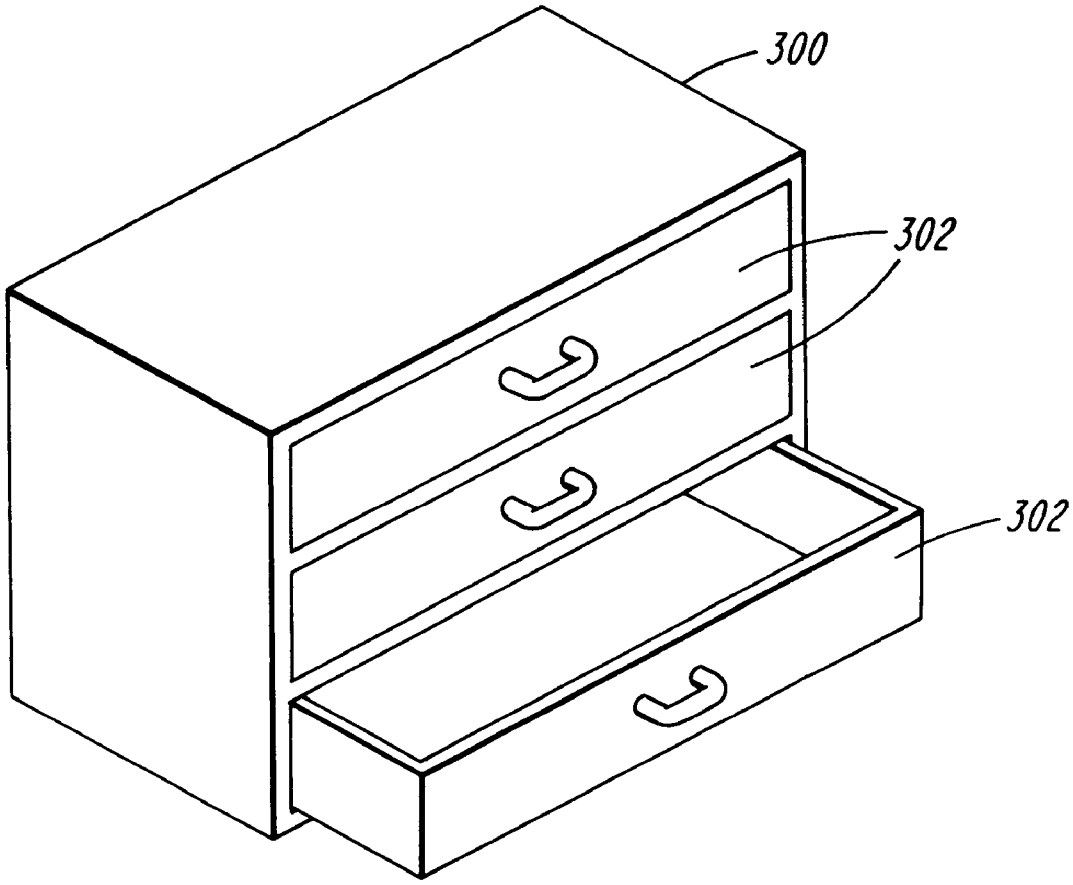
FIG. 10 shows a case element including a number of drawers, wherein each drawer is movably suspended in the case element by means of the presently disclosed drawer guides.

FIG. 10 shows a case element including a number of drawers 302, wherein each of the drawers 302 is movably suspended in the case element 300 by means of the present disclosed drawer guides.

The invention is by no means limited to the exemplary embodiments as described and shown. Many variations thereto are possible.

For instance, the securing elements 26 and the band-shaped element 25 can of course be constructed in many different manners, and combinations of the different exemplary embodiments shown or described can be formed. Various different section shapes and bearings may be used in drawer guides according to the invention, according to the users' preferences and wishes. For instance, for obtaining a proper grip, the control means such as the wheels 126 can be included between the sections in a slightly compressed manner, but they can for instance also be provided with a profile suitable for that purpose, as can the treads of the sections. Moreover, the movement-control means can be drivable in a manner other than by means of the drawer guide sections, for instance electrically.

These and many comparable modifications are understood to fall within the framework of the invention.

What is claimed is:

1. A drawer guide of the over-extendible type, comprising at least a first, a second and a third section, wherein relative to the second section, the first and the third section are oppositely slidable in longitudinal direction, further comprising movement-control means for controlling the movements of the sections of the drawer guide relative to one another, wherein the movement-control means comprise at least a first and a second control means, wherein movements of the control means are dynamically coupled by coupling means, in such a manner that said controlling of the movements of the sections is maintained during the complete path of movement of the sections, wherein the coupling means comprise an elongated connecting element connected to the first and the second control means, the first control means is fixedly connected to the first section and the second control means is fixedly connected to the third section, characterized in that, the first section extends on a first side of the second section and the third section extends on the opposite, second side of the second section, the connecting element forming a closed loop around the second section, in a substantially horizontal plane, said first second and third section having a generally C-shaped cross section, the second section being enclosed between the first and third sections.

2. A drawer guide according to claim 1, characterized in that the second section comprises guide means for the connecting element, each guide means comprising a guide roll or a smooth spherical surface along which the connecting element is guided.

3. A drawer guide according to claim 2, characterized in that:

each control means is substantially arrow-shaped and comprises at least one clamping part, wherein each section to which the relevant control means is to be connected comprises receiving means for receiving the relevant control means, wherein, during positioning of the control means, the relevant first or third section is slid over or at least along the second section in such a manner that the relevant control means is received in the receiving means and confined therein against displacement in that at least one spring element engages behind an abutment edge of the receiving means; and the drawer sections have a generally C-shaped cross section, at least one of the drawer sections at least partly enclosing at least one of the further drawer sections.

4. A case element comprising a number of drawers, wherein each drawer is movably suspended in the case element by means of drawer guides according to claim 3.

5. A drawer guide according to claim 1, characterized in that each control means is substantially arrow-shaped and comprises at least one clamping part, wherein each section to which the relevant control means is to be connected comprises receiving means for receiving the relevant control means, wherein, during positioning of the control means, the relevant first or third section is slid over or at least along the second section in such a manner that the relevant control means is received in the receiving means and confined therein against displacement such that at least one spring element engages being an abutment edge of the receiving means.

6. A drawer guide according to claim 1, further comprising at least one section that is designed so as to be over-extendible two-sidedly.

7. A drawer guide according to claim 1, characterized in that at least one of the sections of the drawer guide at least partly encloses at least one of the further sections of the drawer guide.

8. A case element comprising a number of drawers, wherein each drawer is movably suspended in the case element by means of drawer guides according to claim 1.

* * * * *

UNITED STATES PATENT AND TRADEMARK OFFICE

CERTIFICATE OF CORRECTION

PATENT NO. : 6,231,143 B1
DATED : May 15, 2001
INVENTOR(S) : Andreas Petronella Maria Stijns It is certified that error appears in the above-identified patent and that said Letters Patent is hereby corrected as shown below:

Column 5,
Line 41, “attained” should read -- attached --;

Column 6,
Line 19, “23” should read -- 24 --;
Line 23, “26” should read -- 16 --;

Column 7,
Line 43, “in tough with” should read -- in touch with --;

Column 9,
Line 6, “cable 256” should read -- cable 255 --;
Line 29, “260.” should read -- 250. --; and Column 12,
Line 2, “being” should read -- behind --.

Signed and Sealed this

Twenty-seventh Day of August, 2002

*Attest:*

*Attesting Officer*

JAMES E. ROGAN
*Director of the United States Patent and Trademark Office*